US009856000B1

(12) United States Patent
Midler

(10) Patent No.: US 9,856,000 B1
(45) Date of Patent: Jan. 2, 2018

(54) UNIVERSAL MOUNTING SYSTEM FOR WATERSPORT BOARD

(71) Applicant: Phillip McCoy Midler, Texas City, TX (US)

(72) Inventor: Phillip McCoy Midler, Texas City, TX (US)

( * ) Notice: Subject to any disclaimer, the term of this patent is extended or adjusted under 35 U.S.C. 154(b) by 0 days.

(21) Appl. No.: 15/420,089

(22) Filed: Jan. 30, 2017

(51) Int. Cl.
*B63B 35/85* (2006.01)
*B63B 35/79* (2006.01)

(52) U.S. Cl.
CPC ..... *B63B 35/85* (2013.01); *B63B 35/793* (2013.01); *B63B 35/7906* (2013.01); *B63B 35/7923* (2013.01); *B63B 35/7926* (2013.01); *B63B 2755/00* (2013.01)

(58) Field of Classification Search
CPC ..... B63B 35/7906; B63B 35/793; B63B 35/7923; B63B 2755/00; B63B 35/85; B63B 35/79; B63B 35/7903; B63B 35/7926; B63B 35/7933
See application file for complete search history.

(56) References Cited

U.S. PATENT DOCUMENTS 2,919,452 A * 1/1960 Kluge ..... B63B 35/812 441/70
3,049,734 A * 8/1962 Johnson ..... B63B 35/812 280/633
4,718,873 A * 1/1988 Shaw ..... B63B 35/812 441/70
4,789,368 A 12/1988 D'Onofrio
4,964,826 A * 10/1990 Lobe ..... B63B 35/793 114/132
5,030,151 A 7/1991 Beacham
D428,459 S * 7/2000 Broz ..... D21/769
6,817,622 B2 * 11/2004 Dodge ..... A63C 10/20 280/14.22
2008/0191423 A1 8/2008 Cohen
2012/0279436 A1 11/2012 Hort et al.
2016/0355236 A1 12/2016 Liu

FOREIGN PATENT DOCUMENTS

AU 197018647 A1 2/1972
AU 6518065 A1 4/1988
FR 2594785 A1 8/1987
WO 7048172 A1 5/2007

* cited by examiner

*Primary Examiner* — Ajay Vasudeva
(74) *Attorney, Agent, or Firm* — Karen B. Tripp

(57) ABSTRACT

A universal mounting system for mounting an accessory to a watersport board has at least one mounting plate. The mounting plate has a bottom surface adapted to be mounted to the watersport board, and a top surface. A first track and a second track are integrated with the mounting plate. At least one slider fastener is adapted to cooperate with each of the first and second tracks. The slider fasteners are further adapted to secure the accessory to the mounting plate in a predetermined position.

16 Claims, 4 Drawing Sheets

UNIVERSAL MOUNTING SYSTEM FOR WATERSPORT BOARD

RELATED APPLICATION

This application claims priority from U.S. Provisional Patent Application No. 62/433,787 filed Dec. 14, 2016.

FIELD OF THE INVENTION

The present invention relates to mounting systems for accessories for watersport boards.

BACKGROUND OF THE INVENTION

Many enthusiasts of watersport boards enjoy additional speed, challenge, versatility and the like by mounting accessories to the underside of watersport boards, such as surfboards, stand-up paddle boards, skim boards, wake skates, wake surfers, and the like. Accessories include hydrofoils, electric propulsion systems, fins, fin boxes, and the like. Other accessories include cameras, and the like.

Typically, fins and hydrofoils are provided as accessories that can be attached at a desired destination because the fins and hydrofoils, as well as other accessories, are cumbersome to transport, for example in a vehicle. At the same time, the forces exerted on the fins and hydrofoils can be quite strong in use. Accordingly, a strong mounting system is required to maintain the accessory in position in use in the ocean, for example.

A variety of devices have been developed for mounting accessories for watersport boards. The majority of the devices require first creating a recess in the underside of the board for receiving the accessory. For example, US2016028882A1 (Scott et al) show a fin plug for water craft. The top surface of the fin plug, also referred to as a fin box, has a cavity for receiving the base of a fin. The bottom of the fin box is an extension for holding the fin box in a recess in the water craft. In the disclosed method for installing the fin plug, Scott et al require using a router to carve a "plug hole" into the underside of the water craft to mount the fin plug into the hole, so that the top surface of the fin plug is flush with the underside of the board. Scott et al then apply fiberglass and a coating of resinous material over the top surface to hold the fin plug in place in the board.

Likewise, U.S. Pat. No. 9,457,877B2 (Chung) describe a fin box that is inserted into the body of the watercraft. The fin box requires a recess to be cut into the underside of the watercraft. And U.S. Pat. No. 9,242,707B2 (Yeh) also describes embedding a fin box into the body of a board.

The systems and others like it allow a fin to be detached after use for transport. However, the recess cut into the board can compromise the strength of the board itself. Watersport boards are often made of a foam core wrapped in fiberglass and resin. Cutting into the watersport board therefore "breaks" the shell of the board and many designs therefore rely solely on the foam core which does not have the strength of the fiberglass/resin shell. Accordingly, users are often forced to reinforce and/or modify the board construction to ensure strength around the mounting location.

Furthermore, while the fin boxes described above can support fins of different attributes or a new fin if the original is damaged, they are limited to the specific fin for which the fin box is designed. And further, the position of the accessory is typically then limited by the fin box installation position. Accordingly, a user is not able to readily change the position of the accessory.

There is a need for a mounting system that can be installed relatively easily. There is also a need for a mounting system that is adaptable to a wide variety of accessories for watersport boards. Further, there is a need for a mounting system that does not compromise the integrity of the watersport board, while at the same time being sufficiently strong enough to support the accessory during use.

SUMMARY OF THE INVENTION

According to one aspect of the present invention, there is provided a universal mounting system for mounting an accessory to a watersport board, comprising: at least one mounting plate having a bottom surface adapted to be mounted to the watersport board, and a top surface; a first track and a second track integrated with the at least one mounting plate; at least one first track slider fastener adapted to cooperate with the first track and at least one second track slider fastener adapted to cooperate with the second track, the first track slider fastener and the second track slider fastener further adapted to secure the accessory to the at least one mounting plate in a predetermined position.

BRIEF DESCRIPTION OF THE DRAWINGS

The apparatus of the present invention will be better understood by referring to the following detailed description of preferred embodiments and the drawings referenced therein, in which.

DETAILED DESCRIPTION OF THE INVENTION

The present invention provides a universal mounting system that can be used with a wide variety of accessories for watersport boards. The mounting system can be installed relatively easily, without compromising the integrity of the watersport board, while at the same time being sufficiently strong enough to support the accessory during use. More specifically, the mounting system of the present invention can be mounted to a watersport board without the need for a recess in the watersport board.

The present invention can be installed on a variety of watersport boards including, without limitation, surfboards, stand-up paddle boards, skim boards, wake skates, wake surfers, and combinations thereof. Furthermore, a wide variety of accessories can be mounted on the watersport board, including, without limitation, hydrofoils, electric propulsion systems, fins, fin boxes, and the like. Other accessories include cameras, and the like can also be installed with or without the sport accessory.

Figure 1A:
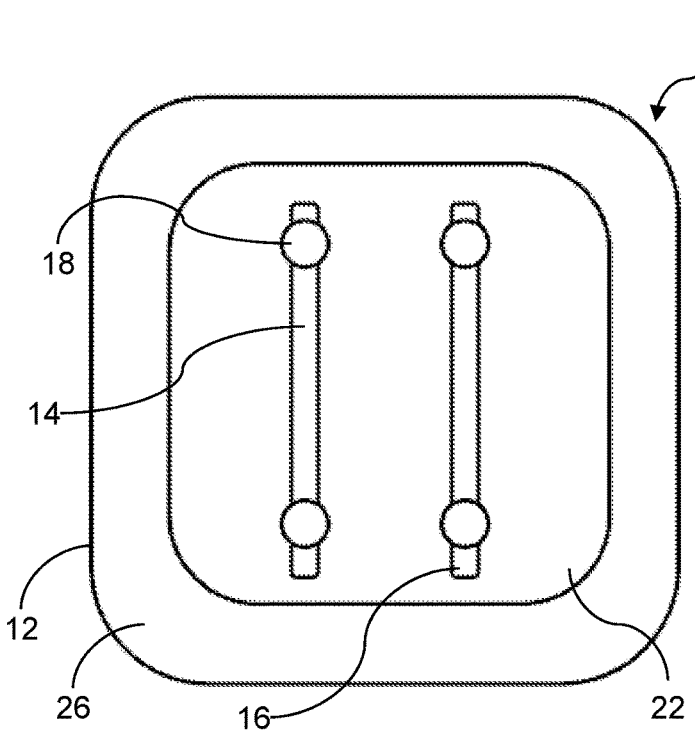
FIG. 1A is a top plan view of one embodiment of a mounting system of the present invention.
Figure 1B:
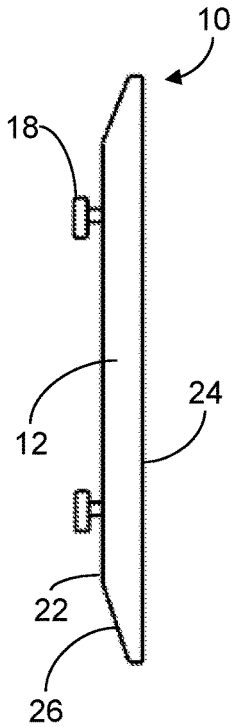
FIG. 1B is a side elevation view of the mounting system of FIG. 1A.
Figure 1C:
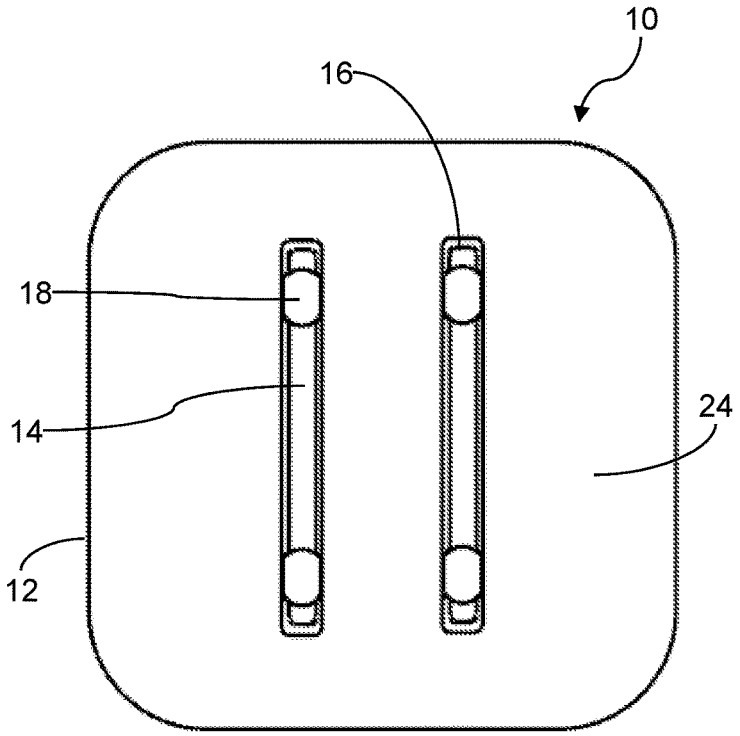
FIG. 1C is a bottom plan view of the mounting system of FIG. 1A.

Referring now to FIGS. 1A-1C, a mounting system 10 of the present invention has at least one mounting plate 12, a first track 14 and a second track 16, and at least one slider fastener 18 for each of the first track 14 and the second track 16.

The mounting plate 12 has a top surface 22 and a bottom surface 24. Preferably, a transition face 26 between the top surface 22 and the bottom surface 24 is sloped so as not to impede the hydrodynamics of the board and/or its accessories.

The bottom surface 24 is adapted to be mounted to the underside of a watersport board. The mounting plate 12 is mounted to the watersport board with a mounting method selected from the group consisting of adhering, bonding, bolting, riveting, screwing, strapping, melting, and combinations thereof. Preferably, the mounting method does not involve penetrating the shell or outer skin of the watersport board, thereby potentially compromising the integrity of the watersport board. Accordingly, preferred methods of mounting the mounting plate 12 to the watersport board are adhering, bonding (e.g. by overlaying fiberglass and resin over the edges of the mounting plate 12 to the watersport board), strapping, melting, and combinations thereof.

More preferably, the mounting method is adhering and the adhering method is conducted using adhesive, adhesive tape, or a combination thereof. Preferably, the adhesive or adhesive tape cures to permanently affix the mounting plate 12 to the watersport board. An example of a suitable adhesive or adhesive tape is based on an acrylic or modified acrylic adhesive. For example, 3M™ VHB™ adhesive tape uses an acrylic or modified acrylic adhesive on a conformable adhesive foam core. Double-sided tape having 3M™ VHB™ brand has been successfully used in practice of the present invention.

The mounting plate 12 can be made of any suitable material. The mounting plate 12 material should be lightweight, waterproof, and provide sufficient strength for holding the components of the mounting system 10, especially when forces are applied to the accessory mounted to the mounting system 10. Additionally, the mounting plate material 12 should be rigid enough to distribute the load evenly. A preferred material for forming the mounting plate 12 is ABS plastic, in view of its cost, weight, stiffness, and strength. It will be understood by those skilled in that art that other materials may be used for the mounting plate 12 without departing from the spirit of the present invention.

Figure 2A:
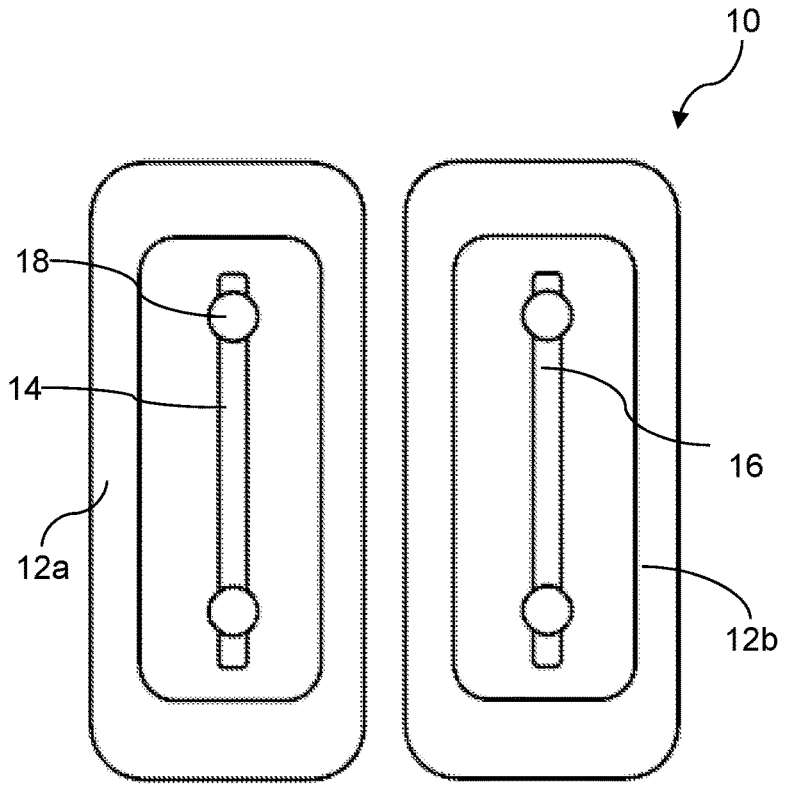
FIG. 2A is a top plan view of another embodiment of a mounting system of the present invention.
Figure 2B:
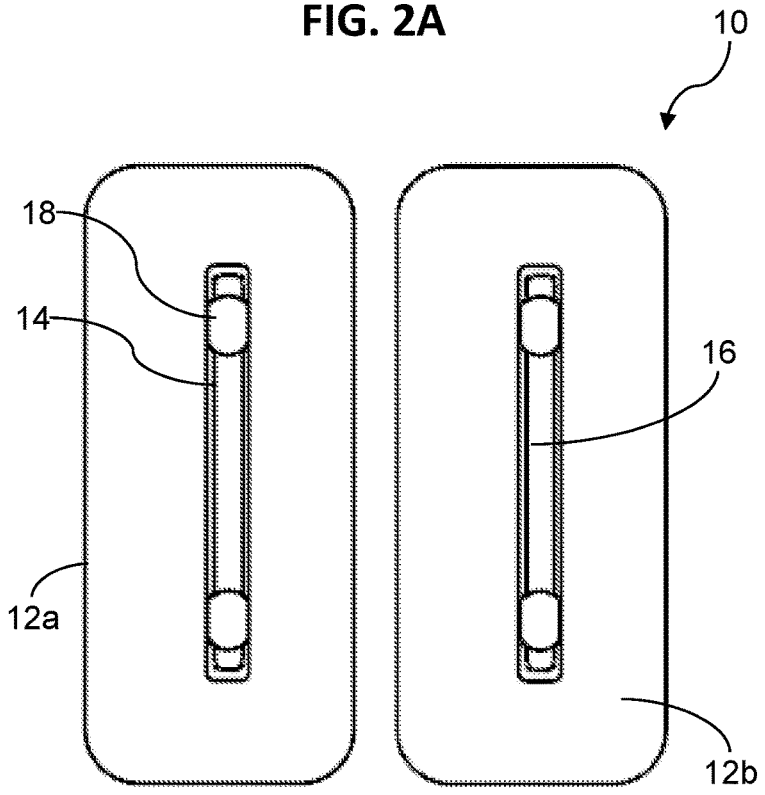
FIG. 2B is a bottom plan view of the mounting system of FIG. 2A.

In an alternate embodiment of the mounting system 10 of the present invention, the at least one mounting plate 12 is at least two mounting plates 12*a*, 12*b*, as depicted in FIGS. 2A and 2B.

Figure 3A:
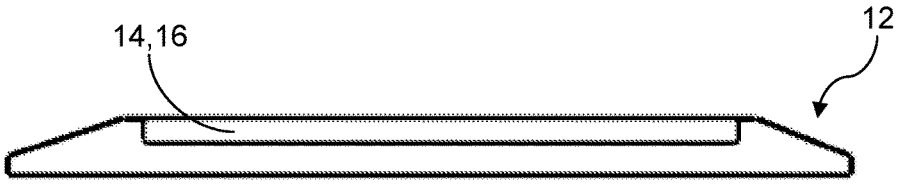
FIGS. 3A-3F are side cross-sectional views of alternate embodiments of mounting plates for use in the mounting system of the present invention.
Figure 3B:
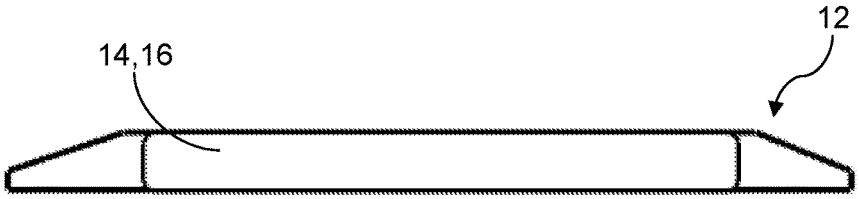
Figure 3C:
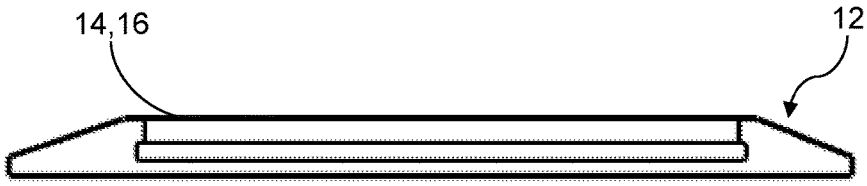
Figure 3D:
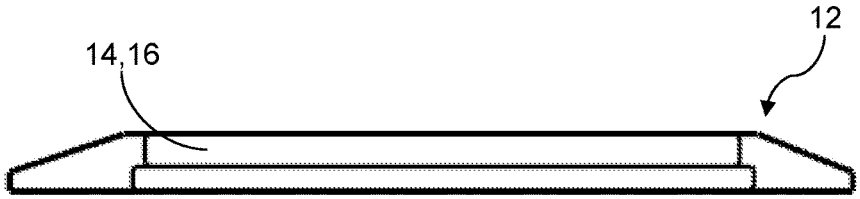
Figure 3E:
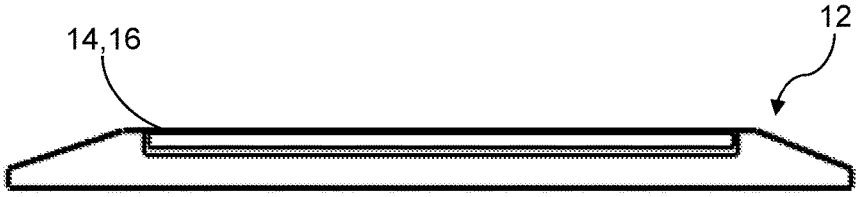
Figure 3F:
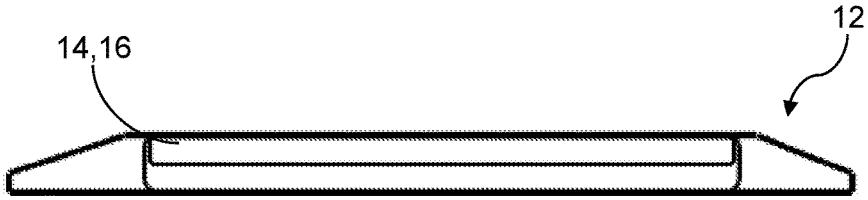

The first track 14 and the second track 16 are integrated with the mounting plate 12. Each track 14, 16 may be formed or routed into the top surface of the mounting plate 12. FIGS. 3A-3F show alternate embodiments of the first track 14 and the second track 16 in mounting plate 12. FIG. 3A shows the first track 14 and the second track 16 formed as a partial-thickness recess, having a uniform width, in a mounting plate 12. FIG. 3B shows the first track 14 and the second track 16 formed as a full-thickness recess from the top surface to the bottom surface, having a uniform width, in a mounting plate 12. FIG. 3C shows the first track 14 and the second track 16 formed as a partial-thickness recess, having a stepped width profile, in a mounting plate 12. FIG. 3D shows the first track 14 and the second track 16 formed as a full-thickness recess, having a stepped width profile, in a mounting plate 12. Alternatively, the first track 14 and the second track 16 may be formed of another material, for example plastic or metal, and pressure-fit or fastened to a formed or routed recess in the mounting plate 12. In an embodiment where the tracks 14, 16 of dissimilar material from the mounting plate 12 are fastened to a recess in the mounting plate, the fastening may be accomplished by adhering, screwing, riveting, bolting or a combination thereof. Examples of this embodiment are illustrated in FIG. 3E and FIG. 3F. Where the mounting plate 12 is provided as a first mounting plate 12*a* and a second mounting plate 12*b*, the first track 14 and the second track 16 are each integrated with a mounting plate 12*a*, 12*b*.

Figure 4:
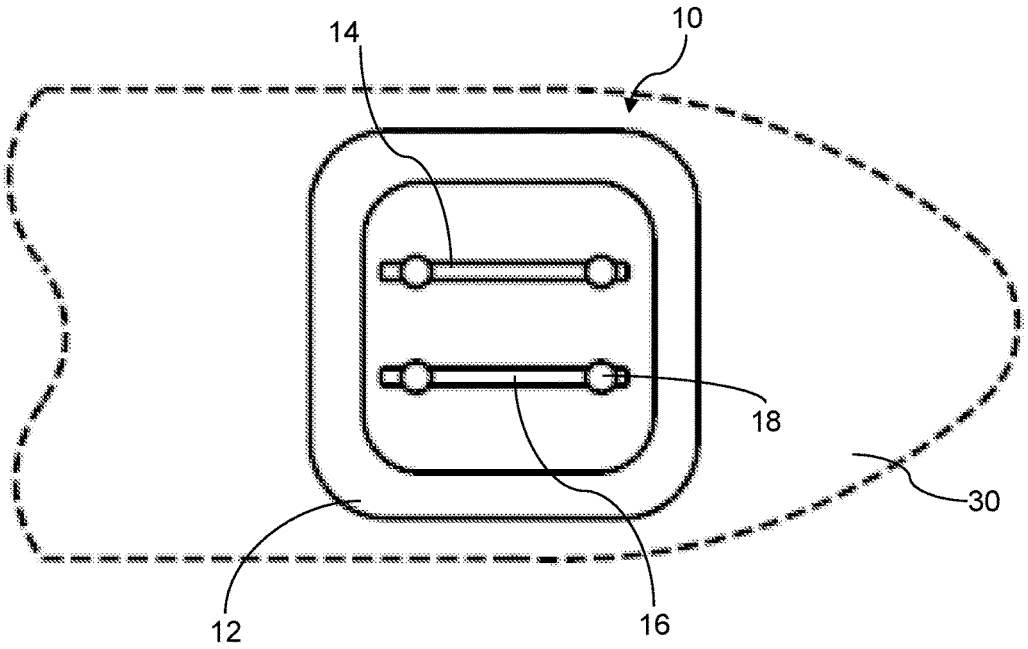
FIG. 4 is a top plan view of a typical installation of one embodiment of the mounting system of the present invention on a watersport board.

The first track 14 and the second track 16 are preferably disposed in parallel relationship to each other. Typically these would be placed on the watersport board so that the first track 14 and the second track 16 extend longitudinally on the watersport board. A typical installation of the mounting system 10 of the present invention is illustrated in FIG. 4, where the first track 14 and the second track 16 in mounting plate 12 extend longitudinally on the underside of a watersport board 30.

It will be understood however that other installations, for example, transverse mounting plate installation, non-parallel first and second track, and the like, of the mounting system 10 of the present invention are possible without departing from the spirit of the present invention.

The mounting system of the present invention has at least one, preferably two, slider fasteners 18 for engaging an accessory to a watersport board. The slider fasteners 18 are adapted to move forward and aft within the first track 14 and the second track 16 while installing the accessory. Once tightened the slider fasteners 18 are locked in place by the installer to secure the position of the accessory relative to the mounting plate 12 at a predetermined position desired by the installer and/or user. In accordance with the mounting system 10 of the present invention, the predetermined position may be adjusted to another predetermined position without further affecting the integrity of the watersport board, i.e., without requiring a new recess to be cut into the watersport board. Likewise, the accessory may be changed to one of the same type or a different type depending on the preference of the user.

Figure 5:
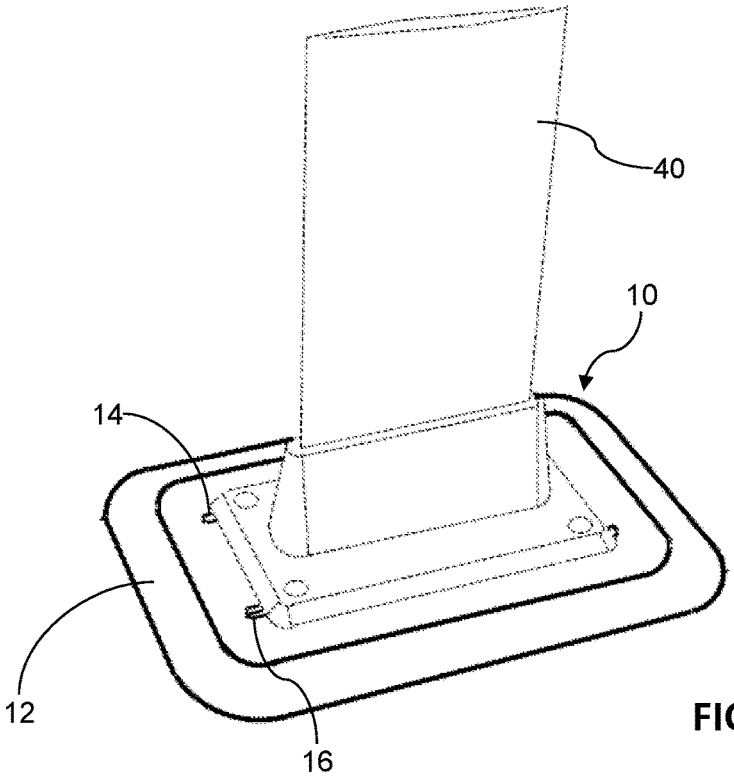
FIG. 5 is a perspective view of an accessory mounted to the mounting system of the present invention.

FIG. 5 illustrates the mounting system 10 of the present invention having an accessory, in this case a hydrofoil 40, mounted to the mounting plate 12. The installer can change the position of the hydrofoil 40 by moving the slider fasteners 18 forward and aft within the first track 14 and the second track 16 prior to tightening the slider fasteners 18, thereby securing the hydrofoil 14 in position.

The slider fasteners 18 may be nuts, bolts, threaded posts, detent ball members, detent teeth members, rods with transverse holes, tubes with transverse holes, and combinations thereof for engaging the accessory.

While preferred embodiments of the present disclosure have been described, it should be understood that various changes, adaptations and modifications can be made therein without departing from the spirit of the invention(s) as claimed below.

I claim:

1. A universal mounting system for mounting an accessory to a watersport board, comprising:

at least one mounting plate having a bottom surface adapted to be mounted to the watersport board, and a top surface, wherein the at least one mounting plate is mounted to the watersport board without the need for a recess in the watersport board;

a first track and a second track integrated with the at least one mounting plate; and at least one first track slider fastener adapted to cooperate with the first track and at least one second track slider fastener adapted to cooperate with the second track, the first track slider fastener and the second track slider fastener further adapted to secure the accessory to the at least one mounting plate in a predetermined position;

whereby the position of the accessory is adjustable relative to the mounting plate, while the position of the mounting plate remains the same relative to the watersport board.

2. The universal mounting system according to claim 1, wherein the first track and the second track are disposed in parallel relationship to one another.

3. The universal mounting system according to claim 1, further comprising a second mounting plate, wherein the first track and the second track are each integrated with the at least one mounting plate and the second mounting plate.

4. The universal mounting system according to claim 1, wherein the first track and the second track are formed in a recess in the top surface of the at least one mounting plate.

5. The universal mounting system according to claim 4, wherein the recess extends from the top surface of the at least one mounting plate to the bottom surface of the at least one mounting plate.

6. The universal mounting system according to claim 1, wherein the first track and the second track are mounted into a recess in the top surface of the at least one mounting plate.

7. The universal mounting system according to claim 1, wherein the first track and the second track are formed of a material dissimilar from the mounting plate and are mounted by a mounting method selected from the group consisting of pressure-fitting, adhering, screwing, riveting, bolting and combinations thereof.

8. The universal mounting system according to claim 1, wherein the at least one mounting plate is mounted to the underside of the watersport board.

9. The universal mounting system according to claim 1, further comprising a transition face between the top surface and the bottom surface of the mounting plate, wherein the transition face is sloped for hydrodynamics.

10. The universal mounting system according to claim 1, wherein the mounting plate is mounted to the watersport board with a mounting method selected from the group consisting of adhering, bonding, bolting, riveting, screwing, strapping, melting, and combinations thereof.

11. The universal mounting system according to claim 10, wherein the mounting method is adhering and the adhering method is conducted using an adherent selected from the group consisting of adhesive, adhesive tape, and combinations thereof.

12. The universal mounting system according to claim 11, wherein the adherent is based on an adhesive selected from the group consisting of acrylic, modified acrylic and combinations thereof.

13. The universal mounting system according to claim 1, wherein there are at least two first track slider fasteners and at least two second track slider fasteners.

14. The universal mounting system according to claim 1, wherein the at least one first track slider fastener and the at least one second track slider fastener are selected from the group consisting of bolts, threaded posts, detent ball members, detent teeth members, rods with transverse holes, tubes with transverse holes, and combinations thereof.

15. The universal mounting system according to claim 1, wherein the watersport board is selected from the group consisting of surfboards, stand-up paddle boards, skim boards, wake skates, wake surfers, and combinations thereof.

16. The universal mounting system according to claim 1, wherein the accessory is selected from the group consisting of hydrofoils, electric propulsion systems, fins, fin boxes, cameras, and combinations thereof.

* * * * *